US006039127A

United States Patent [19]

Myers

[11] Patent Number: 6,039,127

[45] Date of Patent: Mar. 21, 2000

[54] ROCK DRILL

[75] Inventor: Loren D. Myers, Marion, Pa.

[73] Assignee: Loudon Enterprises, Inc., Mercersberg, Pa.

[21] Appl. No.: 09/042,398

[22] Filed: Mar. 13, 1998

[51] Int. Cl.[7] ..... E21B 10/46

[52] U.S. Cl. ..... 175/57; 175/425; 175/433

[58] Field of Search ..... 175/414, 415, 175/417, 418, 425, 426, 433

[56] References Cited

U.S. PATENT DOCUMENTS

| | | | |
|---|---|---|---|
| 3,388,756 | 6/1968 | Varel et al. | 175/418 X |
| 3,590,892 | 7/1971 | Ehlen | 143/133 |
| 3,687,207 | 8/1972 | Harz | 175/410 |
| 4,296,825 | 10/1981 | Larsson | 175/410 |
| 4,303,137 | 12/1981 | Fischer | 175/374 |
| 4,598,779 | 7/1986 | Liljekvist et al. | 175/410 |
| 4,607,712 | 8/1986 | Larsson | 175/410 |
| 4,660,444 | 4/1987 | Sorensen et al. | 175/374 X |
| 4,694,551 | 9/1987 | Mathews | 29/402.08 |
| 4,729,441 | 3/1988 | Peetz et al. | 175/385 |
| 4,756,373 | 7/1988 | Kane et al. | 175/329 |
| 4,765,419 | 8/1988 | Scholz et al. | 175/415 |
| 4,867,803 | 9/1989 | Shikata et al. | 148/3 |
| 4,907,665 | 3/1990 | Kar et al. | 175/410 |
| 4,951,761 | 8/1990 | Peetz et al. | 175/398 |
| 4,953,642 | 9/1990 | Skaggs | 175/393 |
| 5,034,053 | 7/1991 | Nakaai et al. | 75/238 |
| 5,041,173 | 8/1991 | Shikata et al. | 148/321 |
| 5,358,063 | 10/1994 | Hedlund et al. | 175/417 |
| 5,435,401 | 7/1995 | Hedlund et al. | 175/296 |
| 5,482,124 | 1/1996 | Haussmann et al. | 175/415 |
| 5,492,187 | 2/1996 | Neukirchen et al. | 175/394 |
| 5,555,781 | 9/1996 | Pool et al. | 81/436 |
| 5,880,382 | 3/1999 | Fang et al. | 175/374 X |

OTHER PUBLICATIONS

Kathy L. Hayrynen, ADI: Another Avenue for Ductile Iron Foundries, Modern Casting, vol. 85, No. 8, p. 35, Aug. 1995.

*Austempered Ductile Iron*, Sales Brochure.

*What is ADI?*, Sales Brochure.

*The Benefits of Using ADI*, Sales Brochure.

*ADI vs. Forged Steel and Aluminum*, Sales Brochure.

John R. Keough, P.D., ADI—A Designer Gear Material, Gear Technology, Mar./Apr. 1995.

*Primary Examiner*—Frank Tsay

*Attorney, Agent, or Firm*—Duane, Morris & Heckscher, LLP

[57] ABSTRACT

A rock drilling bit for drilling bores in rock, more particularly to a percussion rock drilling bit. Specifically, a rock drilling bit having hard material cutting inserts affixed to an austempered ductile iron (ADI) drill body, and a method of drilling rock using said bit.

19 Claims, 5 Drawing Sheets

ROCK DRILL

1. FIELD OF THE INVENTION

This invention relates to rock drilling bits for drilling bores in rock, more particularly to percussion rock drilling bits. Specifically, the invention is directed to rock drilling bits having hard material cutting inserts affixed to an austempered ductile iron (ADI) body, and a method of drilling rock using such a bit.

2. BACKGROUND OF THE INVENTION

The invention is particularly suited for use in producing rock drilling bits of the type generally referred to as percussion drilling bits and will be described with reference thereto; however, as will become apparent, the invention could equally well be used to produce roller cone bits, polycrystalline diamond compact (PCD) bits, and similar bits of the type wherein the cutting is performed by hard material inserts carried in a drill body.

A conventional percussion drill bit comprises a steel drill body having a generally cylindrical mounting shark carrying an axially aligned cylindrical head defining a cutting face. A multiplicity of cylindrical, hard material cutting inserts, generally formed of sintered tungsten carbide, press-fitted in precision drilled openings in the cutting face. The exposed ends of the cutting inserts perform the actual rock cutting by abrading or crushing the rock into rock dust and small particles. The dust and particles are flushed from the drill hole by compressed air or other pressurized fluid supplied through a central passageway in the drill bit and out branch passageways opening on the cutting face. FIG. 1 is a depiction of such a conventional percussion type down-the-hole ("DTH") drill bit. Specifically, FIG. 1 shows a conventional DTH drill bit (10) comprising a drill body (20) having a connecting section (30), defining a rotational axis, means for coupling (35) the drill bit (10) to a percussive unit or other drill device (not shown), a cutting face (40) having a plurality of holes (42) therein (not shown), the cutting face being rigid with the connecting section, a central passageway (45) therethrough (not shown) with at least one branch passageway (50) extending from the central passageway and opening onto the cutting face and at least one recess (60); a plurality of cutting inserts (70) affixed to the cutting face in the plurality of holes, including gauge row inserts (72) located along the outermost periphery of the cutting face, embedded in the cutting face, each cutting insert comprising a carbide body having a rear mounting portion (not shown) embedded in the drill body and a cutting end portion protruding from the drill body.

Typically, the life of a rock drill bit is dependent on the life of the hard material cutting inserts. However, in certain rock formations, such as soft, fractured formations, the bit body itself is subjected to significant erosive wear. In cutting operations in such rock formations, failure of the drill bit often occurs prematurely because of erosion of the drill body, particularly in the area surrounding the cutting inserts. This erosion results in the weakening of the drill body in general. This erosion also may result in a loss of support for the cutting inserts. Specifically, erosion of the drill body at the site of fixation of the cutting inserts weakens the bond between the drill body and the cutting inserts. Eventually, erosion at the site of fixation results in the separation of the cutting insert from the drill body. Once one or more cutting inserts are separated from the drill body, the cutting inserts must be reaffixed to the drill. If reaffixation is not possibly, the drill bit must be retired. The separation of cutting inserts from the drill body is a particular concern with respect to the outer or "gage" row of inserts located along the periphery of the cutting face because the outer periphery of the cutting face is subjected to more erosive conditions than the rest of the cutting face.

In an effort to increase the durability of rock drill bits and to overcome the cutting insert separation problems noted above, various methods have been employed such as increasing the hardness of conventional steel bit bodies by using a higher carbon content steel and heat treating for high hardness; forming the drill bodies from a low carbon content steel and subsequently carburizing and case hardening the drill body; and carburizing and case hardening the cutting face while selectively preventing the penetration of carbon into the cutting face in the areas where the cutting inserts are to be affixed. Notwithstanding, materials of construction and designs which result in rock drill bits which can drill faster and last longer are constantly being sought.

3. SUMMARY OF THE INVENTION

The invention provides rock drill bits having drill bodies comprised of austempered ductile iron. The austempered ductile iron drill bits of the invention have been determined to exhibit exceptional durability and ease of manufacture. The austempered ductile iron drill bits of the invention may also be produced more economically than conventional steel drill bits.

It is an object of the invention to provide rock drill bits having a drill body comprised of austempered ductile iron.

It is another object of the invention to provide a drill bit for drilling rock, comprising: an austempered ductile ilon drill body having a cutting face, a plurality of openings formed in the drill body at the cutting face, and cutting inserts mounted in said openings with cutting end portions extending outwardly from the cutting face.

It is another object of the invention to provide austempered ductile iron drill bodies having a hardness on the Rockwell C scale of at least 40.

It is another object of the invention to provide austempered ductile iron drill bodies having a central passageway and at least one branch passageway for a flushing medium, wherein the branch passageway opens onto the cutting face and extends to the central passageway.

It is another object of the invention to provide austempered ductile iron drill bodies having at least one branch passageway with a non-circular cross-section.

It is another object of the invention to provide austempered ductile iron drill bodies having at least one branch passageway having a cross-section shaped to facilitate the incorporation of a maximum number of cutting inserts on the cutting face.

It is another object of the invention to provide austempered ductile iron drill bodies having at least one recess for facilitating the removal of drill dust and debris.

It is another object of the invention to provide drill bodies comprised of austempered ductile iron produced from ductile iron by a process comprising: heating the drill body cast in ductile iron to an austenitizing temperature of 1550 to 1750° F., preferably 1550 to 1650° F.; isothermally treating the drill body at the austenitizing temperature for an austenitizing period sufficient to produce a fully austenitic matrix, saturated with carbon; quenching the drill body to an austempering temperature of 450 to 600° F. rapidly enough to inhibit the formation of pearlite and to initiate the formation of ausferrite; isothermally treating the drill body at the austempering temperature for an austempering period to produce ausferrite; and, recovering the austempered ductile iron drill body.

It is another object of the invention to provide drill bodies comprised of austempered ductile iron having an austenite carbon content in the range of 1.8 to 4 wt %, preferably 1.8 to 2.4 wt %.

It is another object of the invention to provide a percussion drill bit for drilling a bore through rock, comprising a drill body having a connecting section at a rear end thereof for connection to a percussive unit and defining a rotational axis of the drill bit, and a plurality of cutting inserts embedded in a cutting face at a front end of the drill body, the cutting face being rigid with respect to the connecting section, each cutting insert comprising a hard material body having a rear mounting portion embedded in the drill body, and a cutting end portion protruding from the drill body, wherein the drill body is comprised of austempered ductile iron.

It is also an object of the invention to provide a method for drilling rock, comprising: providing a drill bit having a drill body made of austempered ductile iron having a connecting section defining a rotational axis and a cutting face with a plurality of cutting inserts, including gauge row inserts, embedded therein, the cutting face being rigid with the connecting section, each cutting insert comprising a hard material body having a rear mounting portion embedded in the drill body and a cutting end portion protruding from the drill body; and, rotating the drill bit about the rotational axis such that the gauge row inserts define a diameter of a bore being drilled.

5. BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the spirit and scope of the appended claims. In the drawings, FIG. 1 is a side perspective view of a conventional down the hole rock drill bit;

6. DETAILED DESCRIPTION OF THE PREFERRED EMBODIMENTS OF THE INVENTION

Figure 1:
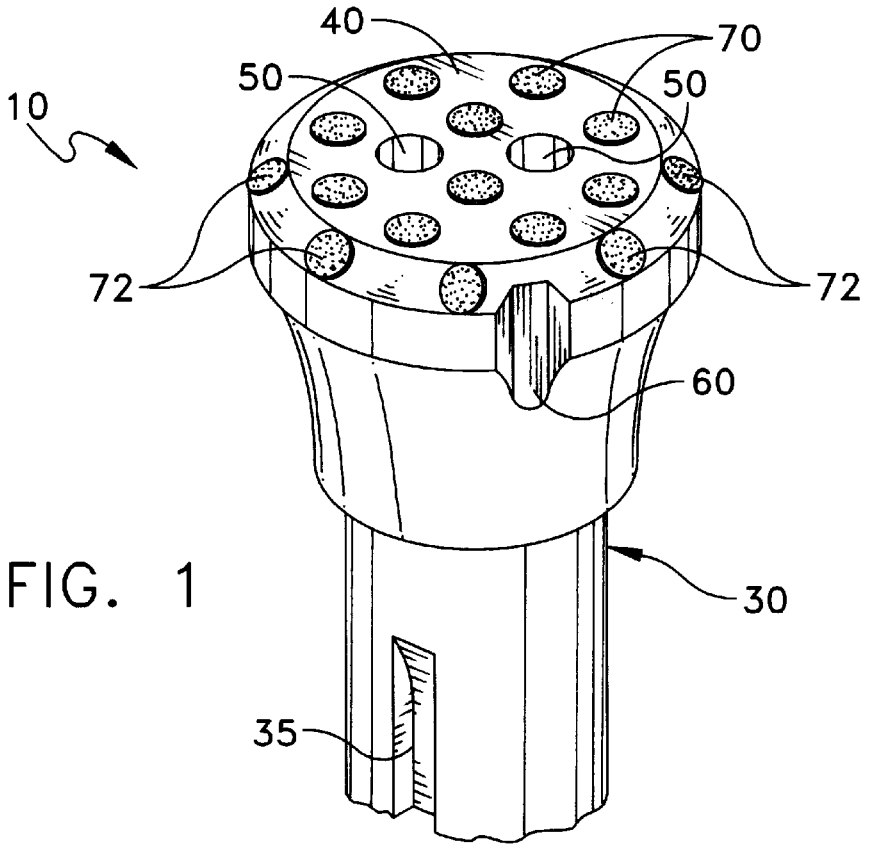

The following detailed description is of the best presently contemplated mode of carrying out the invention. The description is not intended in a limiting sense, and it is made solely for the purpose of illustrating the general principles of the invention. The various features and advantages of the present invention may be more readily understood with reference to the following detailed description taken in conjunction with the accompanying drawings.

The rock drill bits of the invention are characterized by having drill bodies constructed of austempered ductile iron. The rock drill bits of the invention may comprise percussion drill bits, roller cone bits, polycrystalline diamond compact bits, and the like, particularly percussion drill bits.

The austempered ductile iron used in the rock drill bits of the invention consists of acicular ferrite in a high carbon austenite matrix called ausferrite. The austempered ductile iron is produced by heat treating conventional ductile iron which is derived from gray (cast) iron, which exhibits exceptional castibility when compared with steel. Specifically, austempered ductile iron is produced by subjecting conventional ductile iron to a known heat treatment process called austempering. The austempering heat treatment process generally comprises: (1) heating the ductile iron work piece to an austenitizing temperature; (2) isothermally treating the work piece at the austenitizing temperature for an austenitizing period until a fully austenitic matrix saturated with carbon is obtained; (3) quenching the work piece to an austempering temperature rapidly enough to inhibit the formation of pearlite and to initiate the formation of ausferrite; (4) isothermally treating the work piece at the austempering temperature for an austempering period; and (5) recovering the austempered ductile iron work piece. The critical variables in the austempering process are: (1) the austenitizing temperature, (2) the length of the austenitizing period, (3) the cooling rate during the quenching step from the austenitizing temperature to the austempering temperature, (4) the austempering temperature, and (5) the length of the austempering period.

The allowable process conditions during the austempering process and the resultant physical properties of the austempered ductile iron produced thereby are dependant upon the quality and material content of the ductile iron being treated. Defects in the mechanical properties of the ductile iron such as shrinkage, slag stringers and poor microstructural features are magnified in the austempered ductile iron produced therefrom. Accordingly, it is important to use high quality ductile iron when manufacturing the austempered ductile iron drill bits according to the invention. For the purposes of austempering, high quality ductile iron has been defined as that which has: (1) a uniform nodule distribution with a minimum of 100 nodules/mm$^2$, (2) a nodularity exceeding 80%, (3) a carbide and nonmetallic inclusion content not exceeding 0.5%, and (4) a porosity or microshrinkage volume not exceeding 1%.

Figure 2:
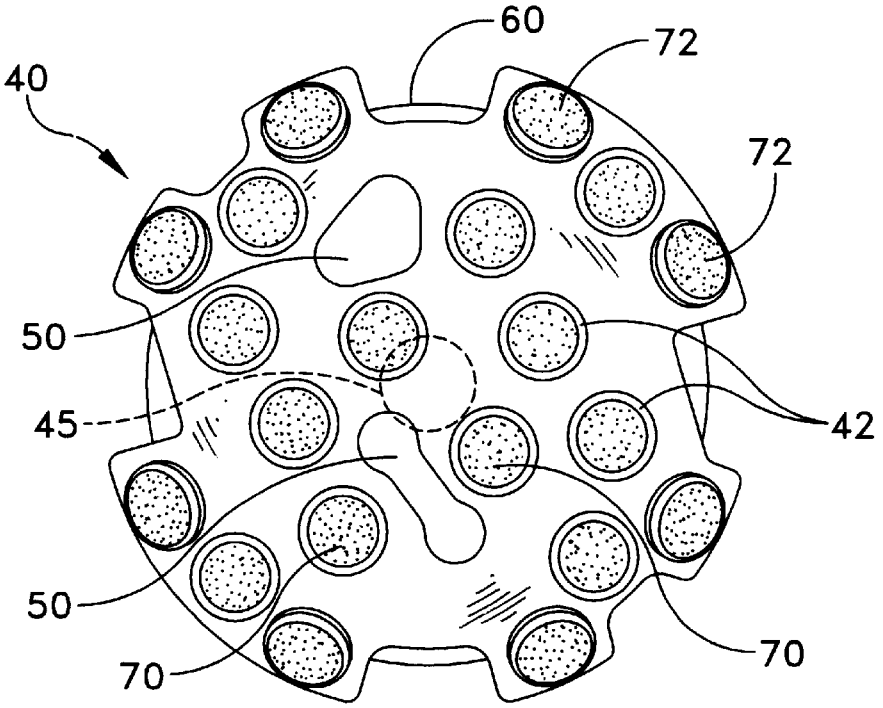
FIG. 2 is a detailed front plan view of the cutting face of a rock drill bit design of the invention wherein the branch passageway openings are different and non-circular.
Figure 3:
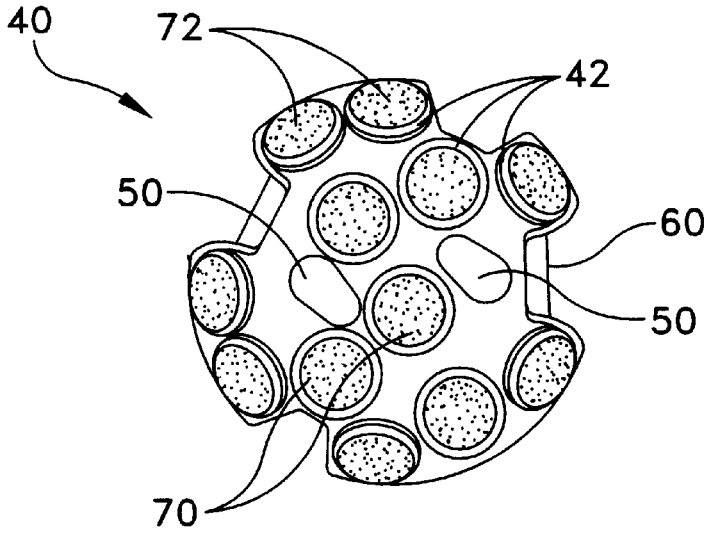
FIG. 3 is a detailed front plan view of the cutting face of a rock drill bit design of the invention wherein the branch passageway openings are identical and non-circular.

The drill bits of the invention are produced by first casting the drill body with high quality ductile iron. The rough cast product may be machined as needed before austempering while the drill body material is still relatively soft and easily machineable. Notwithstanding, many features that must be machined into conventional steel drill bits may be incorporated into the drill bits according to the invention during casting due to the castability of ductile iron. The castability of ductile iron drill bits according to the invention allows for the elimination of up to 90% to 95% of the machining costs associated with conventional steel drill bits. The castibility of ductile iron also makes possible drill bit body configurations which would be difficult and costly and in some cases impossible to achieve using conventional machining techniques. For example, branch passageways (50) in steel drill bodies conventionally have a circular cross-section. FIG. 1 depicts the conventional circular cross-section of the branch passageways. While acceptable for use with the invention, branch passages having a circular cross-section may limit on the total number of cutting inserts which may be incorporated on the cutting face. Because the cutting inserts perform the actual drilling, it is advantageous to incorporate as many cutting inserts as structurally possible on the cutting face of a given drill bit. In some configurations, the use of unique non-circular cross-sections for the branch passageways may facilitate the incorporation of more cutting inserts than would be conceivable on a similar drill bit having branch passageway openings with a circular cross-section. For example, FIG. 2 is a detailed frontal view of the cutting face for a DTH drill bit design of the invention. Specifically, FIG. 2 demonstrates the use of non-circular cross-sections for the branch passageways (50). Furthermore, FIG. 2 demonstrates the use of two or more passageways having different, non-circular cross-sections. Alternatively, FIG. 3 is a detailed frontal view of another cutting face for a threaded button drill bit design of the invention wherein the two branch passageways (50) are of identical non-circular cross section. By using such non-circular cross-sectional branch passageways, the number of cutting inserts which may be incorporated into the cutting face may be maximized.

The optionally machined cast ductile iron drill body is then converted into austempered ductile iron using the austempering heat treatment procedure described herein. Specifically, high quality ductile iron in ASTM A897-90 Grade 3, 4 or 5, may be used to form the drill bodies. The ductile iron drill bodies may be converted to austempered ductile iron using a thermal austempering treatment generally comprising: (1) heating the ductile iron drill body to an austenitizing temperature of 1550 to 1750° F., preferably 1550 to 1650° F.; (2) isothermally treating the drill body at the austenitizing temperature for an austenitizing period sufficient to produce a fully austenitic matrix, saturated with carbon; (3) quenching the drill body to an austempering temperature of 400 to 600° F., rapidly enough to inhibit the formation of pearlite and to initiate the formation of ausferrite, preferably at a rate of 30,000° F./min.; (4) isothermally treating the drill body at the austempering temperature for an austempering period, producing ausferrite having an austenite carbon content in the range of 1.8 to 4 wt %, preferably 1.8 to 2.4 wt %; and, (5) recovering the austempered ductile iron drill body.

Figure 4:
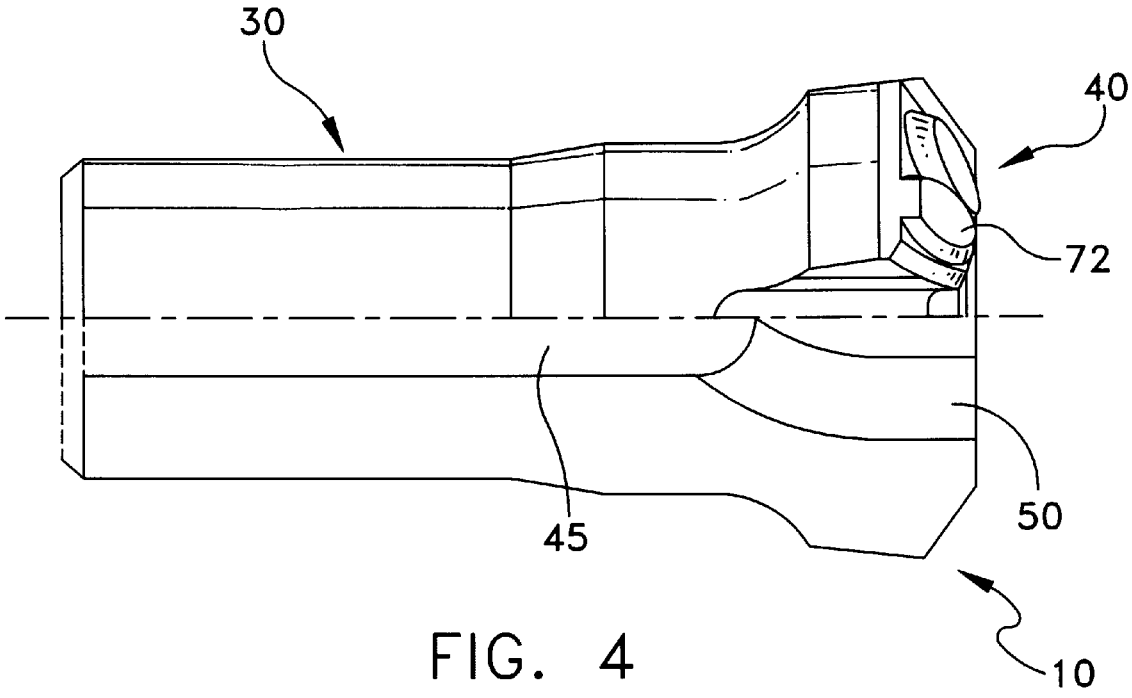
FIG. 4 is a partial cutaway side plan view of a rock drill showing the central passageway and the branch passageway.

The austempered drill body may be further processed by, for example, shot peening, as required to provide the drill body with the desired surface hardness. The austempered ductile iron drill body may also be work hardened. Specifically, percussion rock drill bits operate by breaking rock in front of the drill bit into small pieces or rock dust. The percussion rock drill bits are used in conjunction with a percussive unit which operates to rotate the drill bit about its axis and to simultaneously propel the drill bit into the rock formation to be drilled in a reciprocating manner. Also, high velocity flushing fluid is passed through the central passageway into the branch passageways out the cutting face into the bore during the drilling process. FIG. 4 is a partial cutaway view of a conventional rock drill bit showing the central passageway (45) and the at least one branch passageway (50). This high velocity fluid forces the rock dust out from in front of the drill bit to the periphery of the cutting face, through recesses on the drill bit and up and out of the bore. During this process, broken pieces of rock are constantly impacting on the surfaces of the drill bit. Conventional steel drill bits are abraded and worn down by this constant impacting. The surface of austempered ductile iron rock drill bits, however, become harder as a result of this constant impacting. Thus, the constant impacting associated with use, operates to work harden austempered ductile iron drill bits, thereby enhancing their surface wear resistance.

Cutting inserts useful with the invention may be made of a material selected from the group consisting of tungsten carbide, coated tungsten carbide, diamond enhanced tungsten carbide, ceramic, hardened steel, and ADI.

The cutting inserts preferably have a rear mounting portion and a cutting end portion. The rear mounting portion is designed to engage one of the plurality of openings on the drill body, cutting face. The cutting inserts may be interfaced with the drill body using conventional attachment methods, including but not limited to, cementing, glueing, welding, compression fitting, and threading.

Preferably, the cutting inserts are affixed to the drill body using a compression fit affixation method, i.e. the cutting inserts are press-fitted into the drill body.

The concepts of the invention will now be illustrated by the following Examples, which are intended to be purely exemplary and not limiting. In each of the following examples the drill body used was obtained by first casting the drill body in ductile iron under the designation ADI grade 2. The drill body was then machined as follows: (1) the outside radial elements were turned on a lathe in two (2) separate operations; (2) the center hole was gundrilled; (3) the splines were hobbed; (4) the air flats were milled; (5) the blowtube seat was bored on a lathe and (6) the scallops and blow holes were done on a horizontal machining center. The machined drill body was then subjected to an austempering heat treatment process consisting of: (1) heating the drill body to an austenitizing temperature of 1550 to 1750° F., preferably 1550 to 1650° F.; (2) isothermally treating the drill body at the austenitizing temperature for an austenitizing period of 100 to 140 minutes; (3) cooling the drill body to an austempering temperature of 575 to 625° F. at a rate of 30,000° F./min.; (4) isothermally treating the drill body at the austempering temperature for an austempering period of 100 to 240 min.; (5) recovering the austempered ductile iron drill body having a hardness on the Rockwell C scale of 37. The drill body was then finish machined using the following processes: (1) the critical guide diameter were turned on a lathe, (2) the insert holes were drilled on a horizontal machining center. Tungsten carbide cutting inserts were then incorporated into the drill body by press fit using a hand-held pneumatic impact hammer.

EXAMPLE 1

Figure 6:
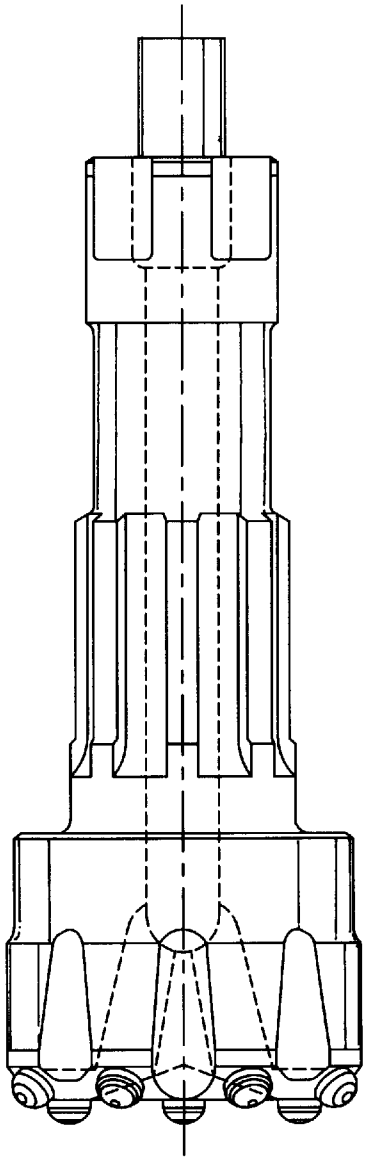
FIG. 6 is a side profile view of the rock drill bit used in the rock drilling test described in Example 1.
Figure 5:
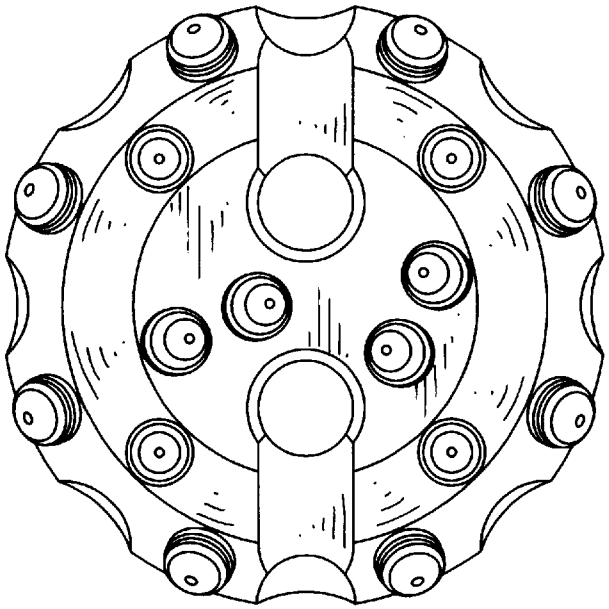
FIG. 5 is a front plan view of the rock drill bit used in the rock drilling test described in Example 1.

Using a rock drill bit of the invention comprising a 6½" diameter concave rock drill bit of the general design depicted in FIGS. 5 and 6, a series of test bores were drilled at the Vulcan Quarry in Stafford, Va. The rock in which the test bores were drilled consisted of granite, the hammer used was an Ingersole-Rand Percussion Air-Hammer Model No. SF6 rotating at 34–36 rpm and operating at a pressure of 320 psi. Before drilling, the rock drill bit had a total weight of 51.89 pounds and had a gage row button diameter of 6.515 inches and a drill body diameter of 6.453 inches. The rock drill bit was then used to drill rock at an average rate of 86 ft/hour. After drilling about 490 feet of rock, the rock drill bit had a total weight of 50.86 pounds and had a gage row button diameter of 6.492 inches and a drill body diameter of 6.318 inches.

EXAMPLE 2

Figure 8:
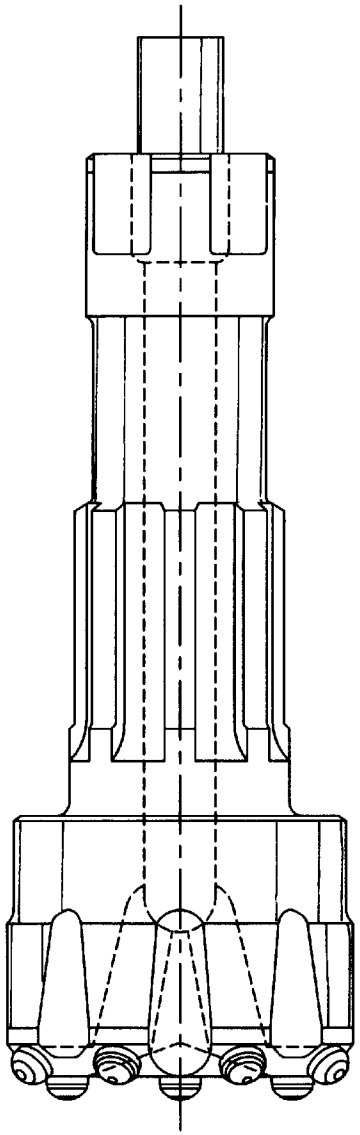
FIG. 8 is a side profile view of the rock drill bit used in the rock drilling test described in Example 2.
Figure 7:
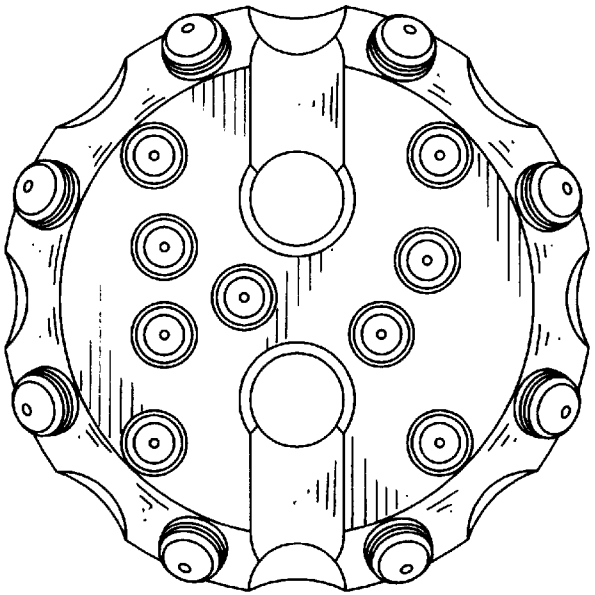
FIG. 7 is a front plan view of the rock drill bit used in the rock drilling test described in Example 2.

Using a rock drill bit of the invention comprising a 6½" diameter flat rock drill bit of the general design depicted in FIGS. 7 and 8, a series of bores were drilled at the Vulcan Quarry in Stafford, Va. The rock in which the test bores were drilled consisted of granite, the hammer used was an Ingersole-Rand Percussion Air-Hammer Model SF6 rotating at 34–36 rpm and operating at a pressure of 320 psi. Before drilling, the rock drill bit had a total weight of 52.45 pounds and had a gage row button diameter of 6.510 inches and a drill body diameter of 6.455 inches. The rock drill bit was then used to drill rock at an average rate of 88 ft/hour. After drilling about 350 feet of rock, the rock drill bit had a total weight of 51.40 pounds and had a gage row button diameter of 6.488 inches and a drill body diameter of 6.358 inches.

EXAMPLE 3

Using a rock drill bit like that used in Example 2, bores were drilled at the Vulcan Quarry in Stafford, Va. The rock in which the test bores were drilled consisted of granite, the hammer used was an Ingersole-Rand Percussion Air-Hammer Model SF6 rotating at 34–36 rpm and operating at a pressure of 320 psi. Before drilling, the rock drill bit had a total weight of 52.45 pounds and had a gage row button diameter of 6.505 inches and a drill body diameter of 6.451 inches. The rock drill bit was then used to drill rock at an average rate of 86 ft/hour. After drilling about 415 feet of rock, the rock drill bit had a total weight of 51.19 pounds and had a gage row button diameter of 6.480 inches and a drill body diameter of 6.355 inches.

EXAMPLE 4

Using a rock bit like that used in Example 2, bores were drilled at the Maryland Materials Quarry in Harve de Grace, Md. The rock in which the test bores were drilled consisted of granite. The hammer used was a Loudon Industries Percussion Air-Hammer Model No. RH6S rotating at 34–36 rpm and operating at a pressure of 320 psi. Before drilling, the rock drill bit had a weight of 52–45 pounds and had a diameter over the gage row buttons of 6.508 inches and a drill body diameter of 6.453 inches. The rock drill bit was then used to drill rock at a rate of 80 ft/hour. After drilling 240 feet of rock, the rock drill bit had a total weight of 51.22 pounds and had a diameter over the gage row buttons of 6.459 inches and a drill body diameter of 6.330 inches.

EXAMPLE 5

Figure 10:
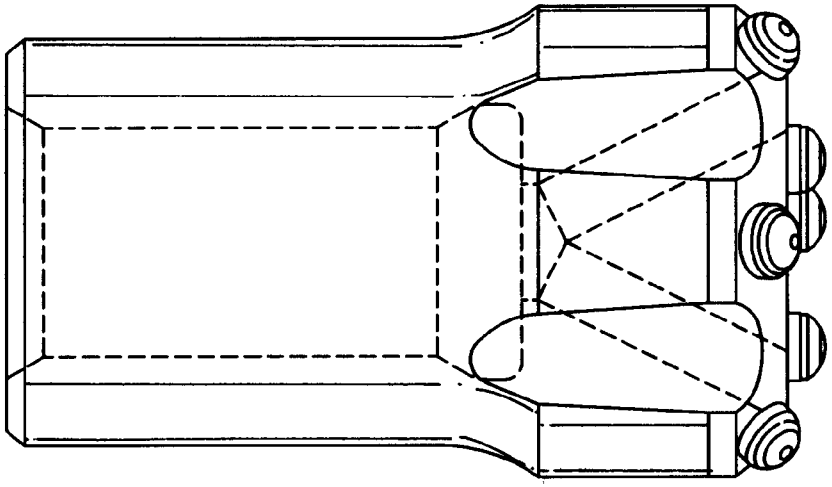
FIG. 10 is a side profile view of the rock drill bit used in the rock drilling test described in Example 5.
Figure 9:
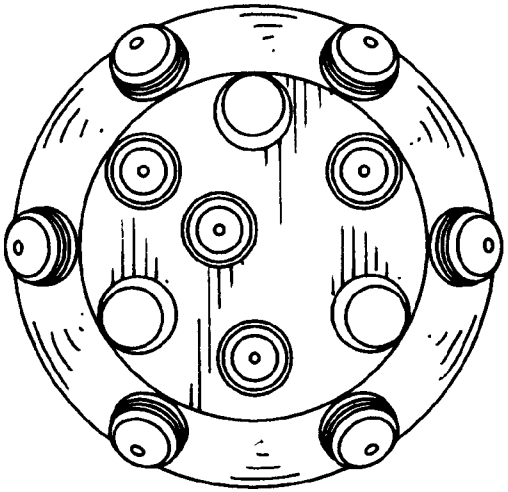
FIG. 9 is a front plan view of the rock drill bit used in the rock drilling test described in Example 5.

Using a rock di-ill bit of the invention comprising a 3½" diameter flat rock drill bit of the general design depicted in FIGS. 9 and 10, a series of test bores were drilled at the Newmont Gold Company in Elko Nev. The rock in which the test bores were drilled consisted of siltstone. The hammer used was a Tamrock Model No. HL 645 rotating at 60 rpm and operating at a pressure of 1,200 psi. Before drilling, the rock drill bit had a diameter over the gage row buttons of 3.506" and a drill body diameter of 3.450". The rock drill bit was then used to drill rock at a rate of 90 ft/hour. The rock drill bit drilled through 4,120 feet of rock before losing four (4) carbide inserts.

While certain present preferred embodiments of the invention have been illustrated and described, it is to be understood that the invention is not limited thereto and may be otherwise practiced within the scope of the following claims.

We claim:

1. A drill bit for drilling rock, comprising:

an austempered ductile iron drill body having a cutting face, a plurality of openings formed in the drill body at the cutting face, and cutting inserts mounted in said openings with cutting end portions extending outwardly from the cutting face, wherein said drill body and said cutting face have substantially a same uniform hardness in a range from about 37 to about 50 on the Rockwell C scale.

2. The drill bit of claim 1, wherein the drill body has a hardness on the Rockwell C scale of at least 40.

3. The drill bit of claim 1, wherein the drill bit is selected from the group consisting of a percussion drilling bit, a roller cone bit, and a polycrystalline diamond compact bit.

4. The drill bit of claim 1, wherein the drill bit is a percussion drilling bit.

5. The drill bit of claim 1, wherein the cutting inserts are made of a material selected from the group consisting of tungsten carbide, coated tungsten carbide, diamond enhanced tungsten carbide, ceramic, hardened steel and austempered ductile iron.

6. The drill bit of claim 1, further comprising a central passageway and at least one branch passageway for a flushing medium, wherein the branch passageway opens onto the cutting face and extends to the central passageway.

7. The drill bit of claim 6, wherein the branch passageway has a non-circular cross-section.

8. The drill bit of claim 6, wherein the drill bit comprises at least two branch passageways.

9. The drill bit of claim 8, wherein the branch passageways have different cross-sections.

10. The drill bit of claim 1, wherein the drill body is provided with at least one recess for facilitating the removal of drill dust and debris.

11. The drill bit of claim 1, wherein the austempered ductile iron drill body is made by heat treating a ductile iron casting as follows:

(a) heating the casting to an austenitizing temperature of 1550 to 1750° F.;

(b) isothermally treating the casting at the austenitizing temperature for an austenitizing period sufficient to produce a fully austenitic matrix, saturated with carbon;

(c) quenching the casting to an austempering temperature of 450 to 600° F., wherein the quenching rate is rapid enough to inhibit the formation of pearlite and to initiate the formation of ausferrite;

(d) isothermally treating the casting at the austempering temperature for an austempering period to produce ausferrite; and, (e) recovering the austempered casting.

12. The drill bit of claim 11, wherein the austempered ductile iron has an austenite carbon content in the range of 1.8 to 4.0 wt %.

13. A percussion drill bit for drilling a bore through rock, comprising a drill body having a connecting section at a rear end thereof for connection to a percussive unit and defining a rotational axis of the drill bit, and a plurality, of cutting inserts embedded in a cutting face at a front end of the drill body, the cutting face being rigid with respect to the connecting section, each cutting insert comprising a hard material body having a rear mounting portion embedded in the drill body, and a cutting end portion protruding from the drill body, wherein the drill body is of a uniform hardness in a range from about 37 to about 50 on the Rockwell C scale and comprised of austempered ductile iron.

14. A method of drilling rock, comprising:

(a) providing a drill bit having: a drill body having a uniform hardness in a range from about 37 to about 50 on the Rockwell C scale and made of austempered ductile iron having a connecting section defining a rotational axis and a cutting face with a plurality of cutting inserts, including gauge row inserts, embedded therein, the cutting face being rigid with the connecting section, each cutting insert comprising a hard material body having a rear mounting portion embedded in the drill body and a cutting end portion protruding from the drill body; and (b) rotating the drill bit about the rotational axis such that the gauge row inserts define a diameter of a bore being drilled.

15. The method of claim 14, wherein drill bit further comprises a central passageway and at least one branch passageway for a flushing medium, wherein the at least one branch passageway opens onto the cutting face and extends to the central passageway, and wherein the at least one branch passageway has a non-circular cross-section.

16. The method of claim 15, wherein the at least one branch passageway comprises at least two branch passageways having different cross-sections.

17. The method of claim 15, wherein the drill body is provided with at least one recess for facilitating the removal of drill dust and debris from the bore.

18. The method of claim 15, wherein the austempered ductile iron drill body is made by heat treating a ductile iron casting by a process comprising:

(a) heating the casting to an austenitizing temperature of 1550 to 1750° F.;

(b) isothermally treating the casting at the austenitizing temperature for an austenitizing period sufficient to produce a fully austenitic matrix, saturated with carbon;

(c) quenching the casting to an austempering temperature of 450 to 600° F., wherein the quenching rate is rapid enough to inhibit the formation of pearlite and to initiate the formation of ausferrite;

(d) isothermally treating the casting at the austempering temperature for an austempering period to produce ausferrite; and, (e) recovering the austempered casting.

19. The method of claim 18, wherein the austempered ductile iron has an austenite carbon content in the range of 1.8 to 4 wt %.

* * * * *